US010624408B1

(12) United States Patent
Ettinger

(10) Patent No.: US 10,624,408 B1
(45) Date of Patent: Apr. 21, 2020

(54) COVERED FORM HAT MAKING SYSTEM

(71) Applicant: Solomon Ettinger, Brooklyn, NY (US)

(72) Inventor: Solomon Ettinger, Brooklyn, NY (US)

( * ) Notice: Subject to any disclaimer, the term of this patent is extended or adjusted under 35 U.S.C. 154(b) by 132 days.

(21) Appl. No.: 16/108,490

(22) Filed: Aug. 22, 2018

(51) Int. Cl.
*A42C 1/04* (2006.01)
*A42C 1/08* (2006.01)

(52) U.S. Cl.
CPC . *A42C 1/04* (2013.01); *A42C 1/08* (2013.01)

(58) Field of Classification Search
CPC ..... A42C 1/00–08; A42C 2/002–007; A42C 3/00; A42C 3/02; B29C 51/004; B29C 51/08; B29C 51/082; B29C 51/087; B29C 51/145
See application file for complete search history.

(56) References Cited

U.S. PATENT DOCUMENTS 234,505 A 11/1880 Thoman
496,929 A 5/1893 Blanchard
513,992 A * 2/1894 Eickmeyer ..... D04D 7/04 112/103
1,392,605 A * 10/1921 Stevens ..... A42C 1/04 223/12
1,639,331 A * 8/1927 Diamond ..... A42C 1/04 223/25
1,644,976 A * 10/1927 Bredow ..... A42C 1/04 223/25
1,649,338 A * 11/1927 Brodin ..... A42C 1/04 223/24
1,683,790 A 9/1928 Muller
1,725,425 A * 8/1929 Steingold ..... A42B 1/22 2/181
1,824,785 A 9/1931 Muhlfeld
1,944,791 A 1/1934 Hodshon
2,008,638 A * 7/1935 Cuming ..... A42C 1/04 223/15
2,100,651 A * 11/1937 Schur ..... A42C 1/02 2/175.9
2,200,102 A * 5/1940 Sepe ..... A42C 1/04 223/24
2,283,660 A 5/1942 Widmann
2,361,345 A * 10/1944 Young ..... A42C 1/02 2/175.3
2,542,676 A * 2/1951 Walker ..... A42C 1/04 223/12
2,713,443 A * 7/1955 Cottrell ..... A42C 1/02 223/12

(Continued)

*Primary Examiner* — Ismael Izaguirre
(74) *Attorney, Agent, or Firm* — Goldstein Law Offices, P.C.

(57) ABSTRACT

A system for creating a covered hat using an upper form having a top surface, a bottom edge, and side walls having an elongated cylindrical shape between the top surface and bottom edge. A stand having an upper block is inserted into the upper form against the top surface. A rigid ring insert is placed within the form and aligned with the bottom edge. A covering sheet made of a textile material having outer edges is centered over the top surface of the upper form. A rope band secures the covering sheet tightly against the upper form and is aligned with the ring insert. The outer edges are pulled downwardly to remove wrinkles, the covering sheet is stitched in place to the upper form, and the upper form is severed just above the ring for subsequent attachment to a hat lower part.

8 Claims, 13 Drawing Sheets

(56) References Cited

U.S. PATENT DOCUMENTS

| | | | | |
|---|---|---|---|---|
| 2,812,887 | A | 11/1957 | Palinkas | |
| 4,995,178 | A * | 2/1991 | Randolph | B44D 3/185 38/102 |
| 5,899,160 | A * | 5/1999 | Hoag | D04D 7/04 112/103 |
| 6,976,612 | B1 | 12/2005 | Miller | |

* cited by examiner

COVERED FORM HAT MAKING SYSTEM

TECHNICAL FIELD

The present disclosure relates generally to a hat making process. More particularly, the present disclosure relates to a system for covering a cylindrical hat upper with a planar sheet of fabric, without wrinkles.

BACKGROUND

In certain locales so-called "velvet hats" are quite popular. The velvet hat has an upper portion which has an elongated cylindrical shape with a flat top, and a lower part which includes a brim that encircles the cylindrical part.

The upper portion has a form that is covered with a soft material that provides a uniform appearance. Typically this material is rabbit or beaver skin because the skin will naturally take the desired shape without wrinkles or creases. Because of the use of animal skins in covering the hat, the user must be very careful to never get the hat wet. Once wet, the hat may be ruined or may require expensive repair.

Even exercising an abundance of caution, however, it is unavoidable to sometimes get caught outdoors in sudden inclement weather. Due to this inherent limitation, it would be highly desirable to use a covering that is made of a synthetic material that is not so vulnerable to damage from water. Attempts to make the hat out of synthetic coverings, including velvet fabric, however, are often stalled by the reality that typical attempts to cover the 3-dimensional hat upper with a 2-dimensional sheet of fabric will result in creases and wrinkles.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to produce a covered hat using a planar covering material. Accordingly, the present disclosure employs a form and a process for covering the form using a planar covering sheet made of a textile material.

It is another aspect of an example embodiment in the present disclosure to provide a hat making process that allows the form to be covered with a planar textile material without wrinkles or creases. Accordingly, the process allows creation of the hat upper by creating extreme tension in the covering material over the form and then stitching the covering material in place.

Accordingly, the present disclosure describes A system for creating a covered hat using an upper form having a top surface, a bottom edge, and side walls having an elongated cylindrical shape between the top surface and bottom edge. A stand having an upper block is inserted into the upper form against the top surface. A rigid ring insert is placed within the form and aligned with the bottom edge. A covering sheet made of a textile material having outer edges is centered over the top surface of the upper form. A rope band secures the covering sheet tightly against the upper form and is aligned with the ring insert. The outer edges are pulled downwardly to remove wrinkles, the covering sheet is stitched in place to the upper form, and the upper form is severed just above the ring for subsequent attachment to a hat lower part.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
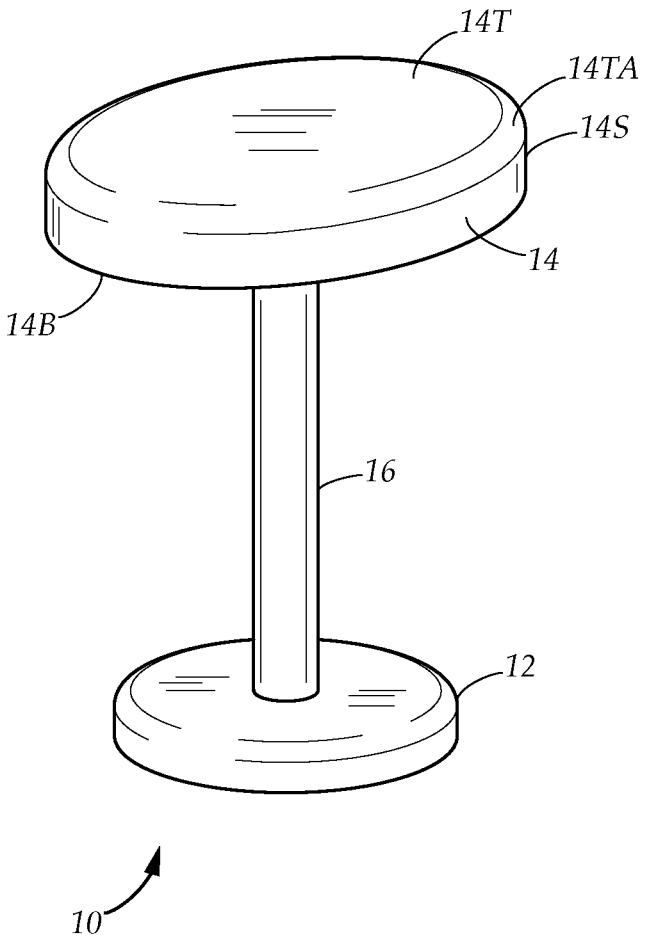
FIG. 1 is diagrammatic perspective view, illustrating a stand and upper block, used in the hat making process described herein.

FIG. 1 illustrates a stand 10, including a base 12 for resting on a horizontal surface, an upper block 14, and a vertical mast 16 extending between the base 12 and upper block 14. The upper block 14 is an elongated cylindrical form with a substantially flat and horizontal top 14T, a bottom edge 14B, and vertical side walls 14S extending downwardly from the horizontal top 14T to the bottom edge 14B. Note that although the side walls 14S are substantially orthogonal to the top 14T, the side walls 14S and top 14T may meet each other with a rounded edge 14TA.

Figure 2:
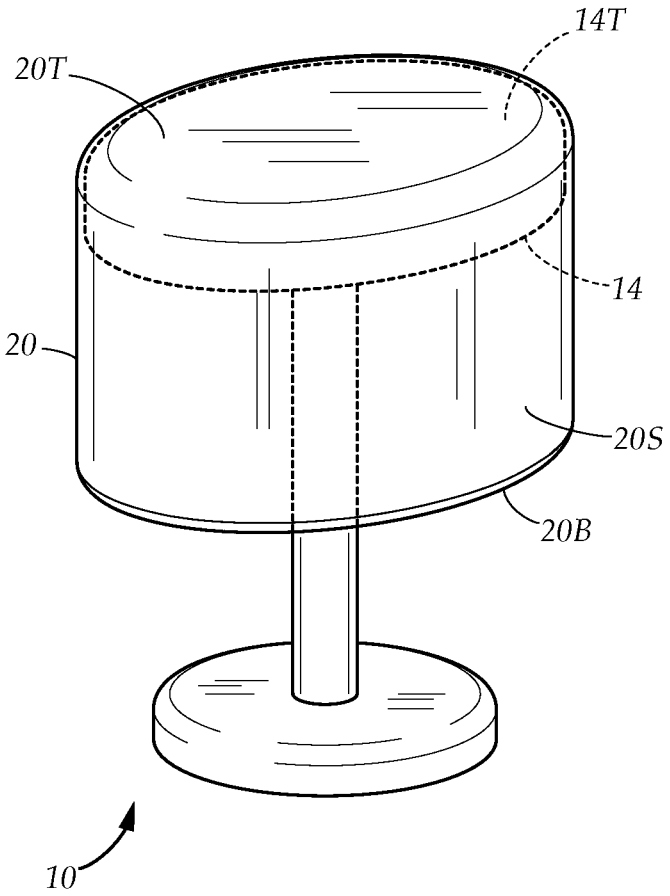
FIG. 2 is a diagrammatic perspective view, illustrating an upper form, positioned over the upper block and supported by the stand.

FIG. 2 illustrates an upper form 20, positioned over and supported by the stand 10, whereby the upper block 14 extends inside the upper form 20. In particular, the upper form 20 has a top 20T, a bottom edge 20B, and is the shape of an elongated cylinder that is closed at the top 20T and open at the bottom edge 20B. Side walls 20S extend vertically between the top 20T and the bottom edge 20B. Note that the upper form 20 is sized and shaped so that the upper block 14 fits snugly within the upper form 20, with the top 14T of the upper block 14 resting against the top 20T of the upper form 20. In this position, the upper block 14 not only supports the weight of the upper form 20, but also supports the upper form 20 against deformation when it is subject to significant downward forces during the steps that will be described in further detail hereinbelow. Accordingly, the upper block 14 closely matches the shape of the upper form 20 so as to maximize surface contact therebetween and thereby minimize deformation as downward forces are transferred between the upper form 20 and upper block 14. The upper block 14, however, is much shorter in vertical height than the upper form 20 and thereby only occupies a portion of the vertical distance between the bottom edge 20B and top surface 20T of the upper form 20.

Figure 3A:
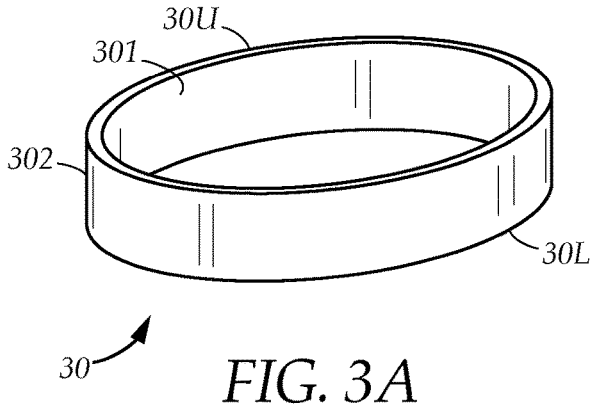
FIG. 3A is a diagrammatic perspective view, illustrating a ring insert, per se.

FIG. 3A show a ring insert 30. The ring insert 30 has an upper edge 30U, a lower edge 30L, and an inner wall 301 and outer wall 302 extending therebetween. The ring insert 30 has a ring diameter that is substantially the same at and between the upper edge 30U and lower edge 30L and has a consistently rectangular cross sectional profile throughout. The ring insert 30 is substantially rigid so as to maintain its circular shape even when compressed on the outer wall 302 and is preferably made of metal.

Figure 3B:
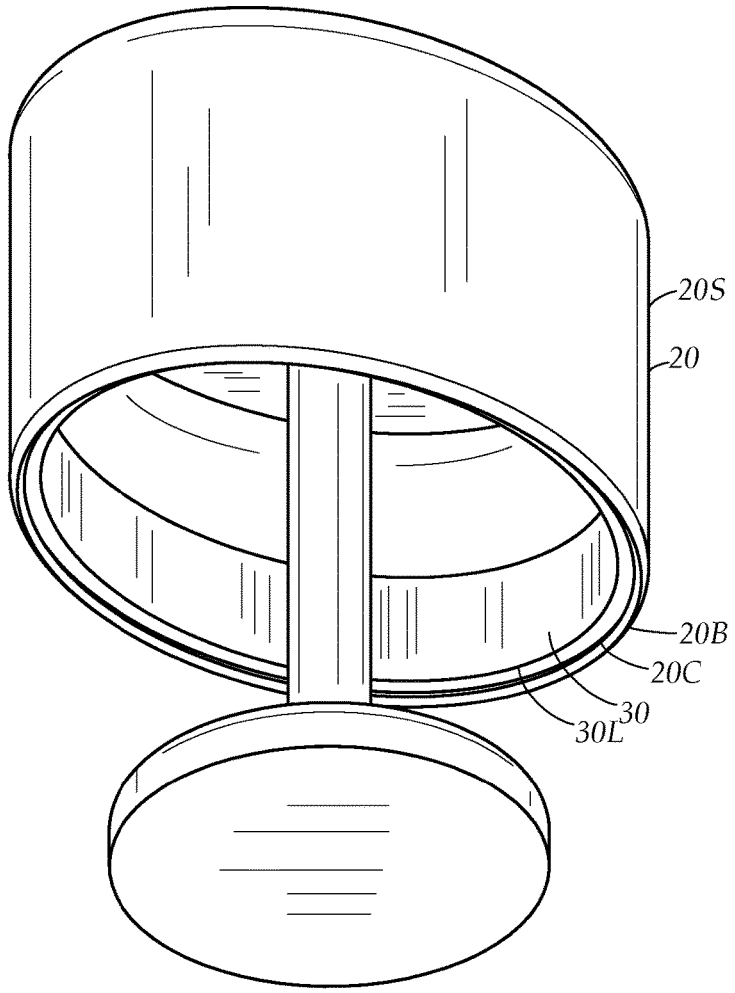
FIG. 3B is a diagrammatic perspective view, illustrating the ring insert positioned within the upper form along a lower edge thereof.
Figure 3C:
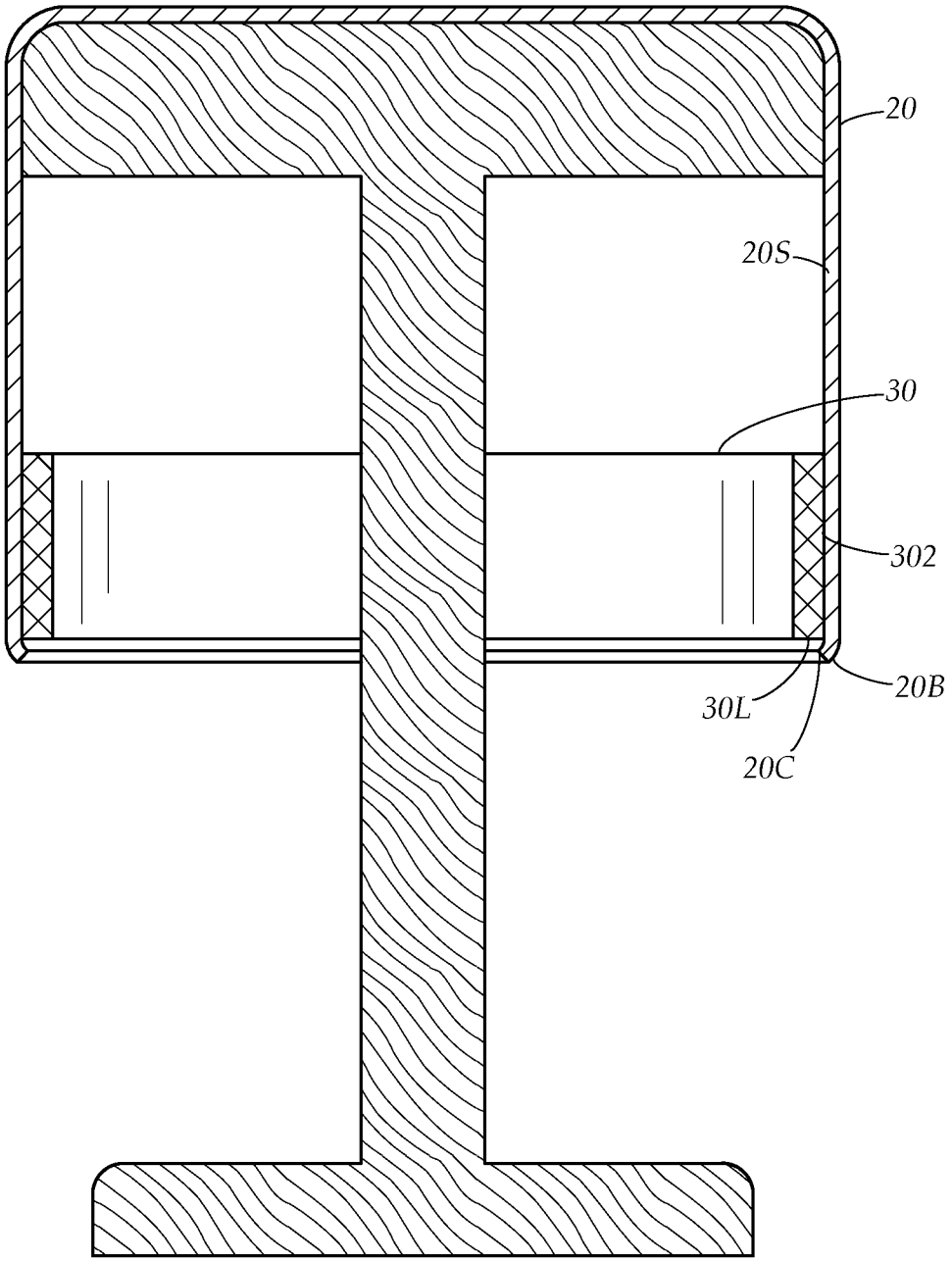
FIG. 3C is a front elevational view with parts broken away, illustrating the upper form supported on the stand by the upper block, with the ring insert positioned within the upper form along a lower edge thereof.

FIG. 3B and FIG. 3C illustrate the ring insert 30 positioned within the upper form 20 along a bottom edge 20B thereof. In particular, the lower edge 30L of the ring insert 30 is substantially aligned with the bottom edge 20B of the upper form 20. The outer wall 302 of the ring insert 30 is slightly smaller in diameter than the side walls 20S of the upper form 20. Note that the ring insert 30 may be held in place by a frictional fit and/or by a circumferential lip 20C the protrudes slightly inwardly at the bottom edge 20B of the upper form 20. Since the upper form 20 is flexible, it may be flexed as needed to 'work' the ring insert 30 into position, whereupon it is held in place by frictional fit and/or by the circumferential lip 20C.

Figure 4:
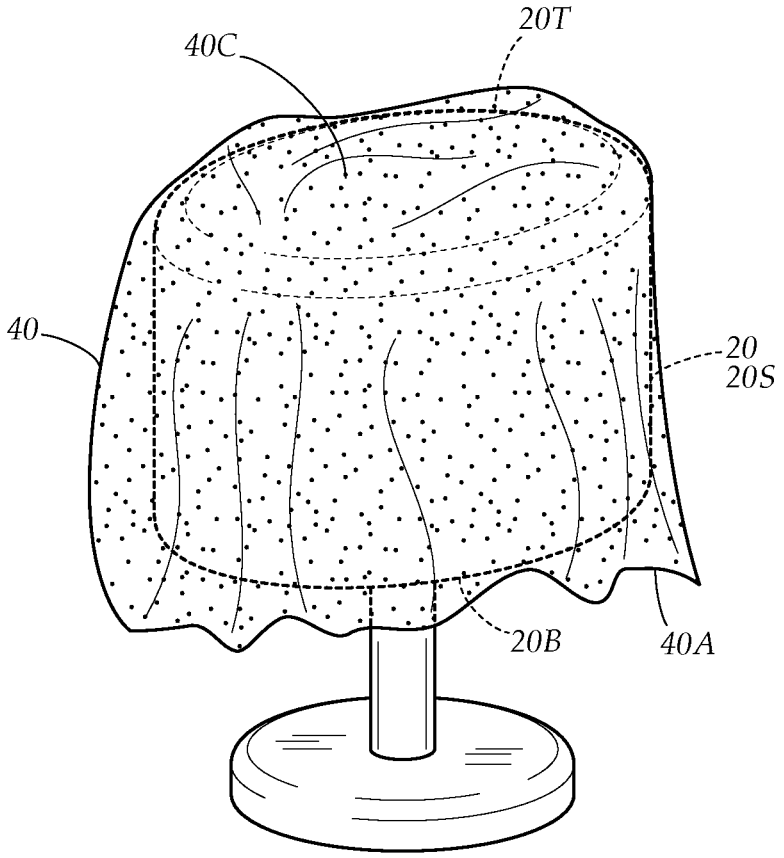
FIG. 4 is a diagrammatic perspective view, similar to FIG. 3B, except wherein a covering sheet, made of a fabric material, has been placed over the upper form, covering the top surface therein and draping downwardly over the side walls thereof.

Next in FIG. 4, a covering sheet 40 has been placed over the upper form 20, covering the top surface 20T thereof and draping downwardly over the side walls 20S. Note that the covering sheet 40 is a generally planar textile material that may be a woven or knit fabric created from a variety of synthetic and/or natural threads and fibers. The covering sheet 40 has a center 40C and outer edges 40A that define a perimeter of the covering sheet 40. The center 40C is positioned over the top surface 20T of the upper form 20 and the outer edges 40A of the covering sheet 40 will generally extend below the bottom edge 20B of the upper form 20.

Figure 5:
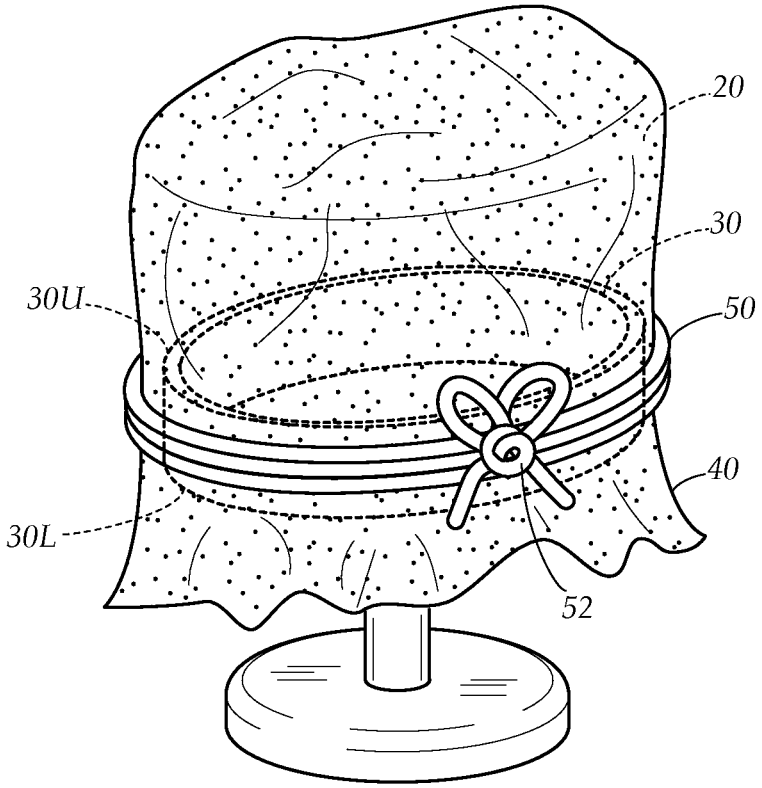
FIG. 5 is a diagrammatic perspective view, similar to FIG. 4, except wherein a rope band has been wrapped around the upper form parallel to and coinciding with the ring insert, and have been tightened against the ring insert with the covering sheet and form extending therebetween.

After the covering sheet 40 is suitably positioned upon the upper form 20, referring to FIG. 5, a rope band 50 is secured tightly against the covering sheet 40 on an opposite side thereof from the upper form 20. The rope band 50 extends in a closed loop that extends around the upper form 20 at least once and preferably several times, and may include a rope band knot 52 to close the loop. The rope band 50 is fully between the upper edge 30U and lower edge 30L of the ring insert 30. Accordingly, the rope band 50 exerts significant inward force against the covering sheet 40 and against the upper form 20 that are sandwiched between the rope band 50 and the upper form 20.

Figure 6:
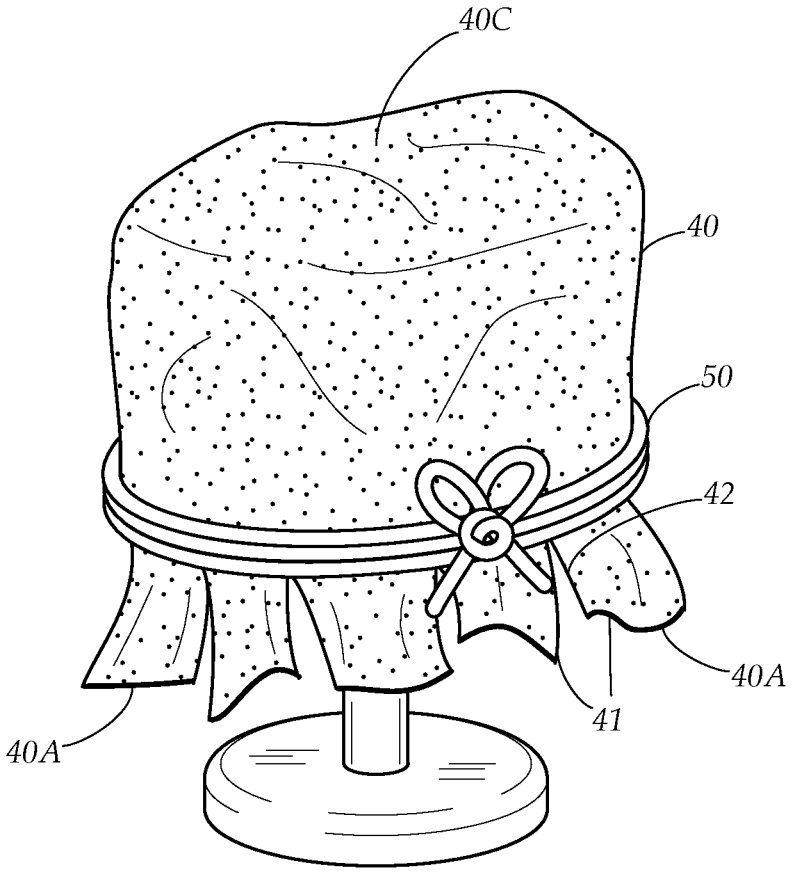
FIG. 6 is a diagrammatic perspective view, similar to FIG. 5, except wherein the covering sheet has been sliced from the outer edges of the sheet upwardly toward the ropes to create pulling strips.

With the rope band 50 tightly in place, referring to FIG. 6, the covering sheet 40 is cut into strips 41 by creating substantially radial cuts 42 that extend from the outer edge 40A toward the center 40C but do not continue upwardly past the rope band 50. The strips 41 each provide a handle for tensioning the covering sheet 40 as will be described in further detail hereinbelow.

Figure 7:
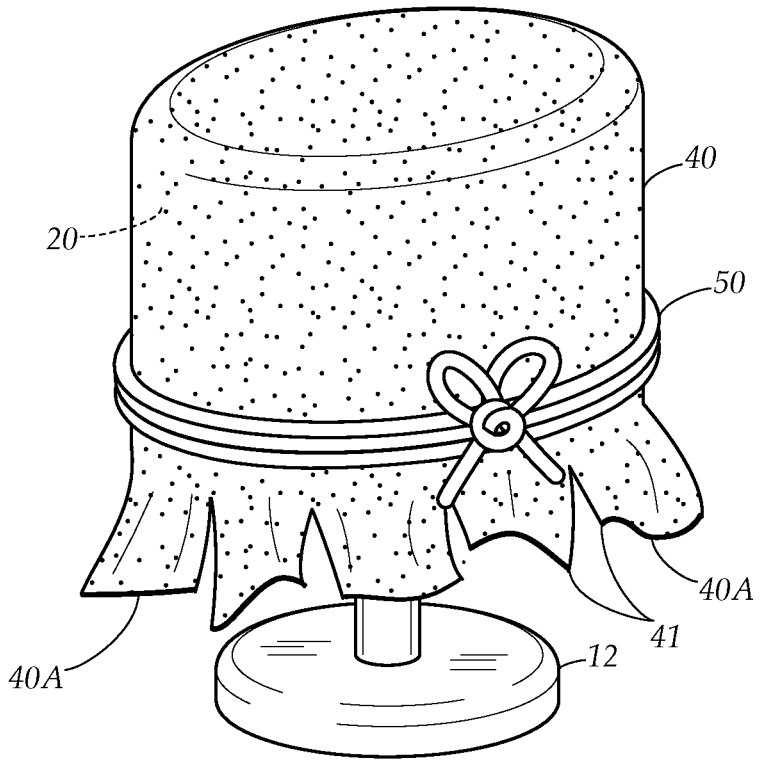
FIG. 7 is a diagrammatic perspective view, similar to FIG. 6, except wherein the pulling strips have been pulled with extreme tension to systematically remove all of the creases and wrinkles previously seen in FIGS. 4, 5, and 6.
Figure 9:
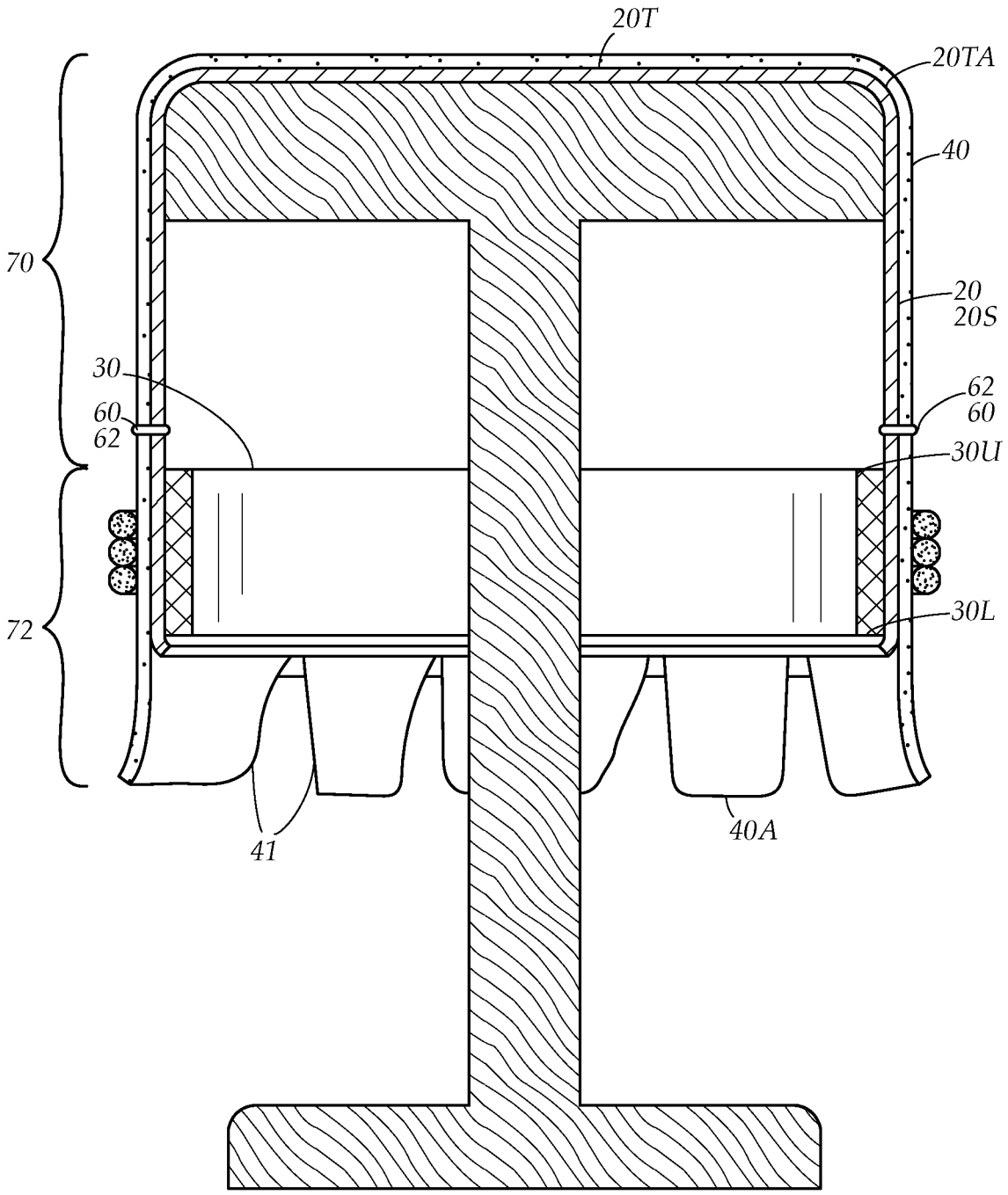
FIG. 9 is a front elevational view with parts broken away, illustrating the upper form supported on the stand by the upper block, covered by the covering sheet and stitched thereto, and held tightly against the ring with the ropes.

Referring now to FIG. 7, the strips 41 have been pulled downwardly toward the base 12, one at a time, until all creases and wrinkles have been removed and the covering sheet 40 has a smooth and continuous appearance, even at the transition between the top 20T and side walls 20S of the upper form 20 (referring momentarily to FIG. 9). Advantageously, when the covering sheet 40 is pulled downwardly under significant pressure at the outer edge 40A, the inward pressure and frictional force of the rope band 50 can be dynamically overcome, and the covering sheet 40 moves to a new position where it is tighter against the upper form 20 and thereby eliminating one or more creases and/or wrinkles. Unexpectedly, however, when the strips 41 of the covering sheet 40 are released at the outer edge 40A, the inward force of the rope band 50 maintains this new position with static friction between the rope band 50, covering sheet 40 and upper form 20.

Figure 8:
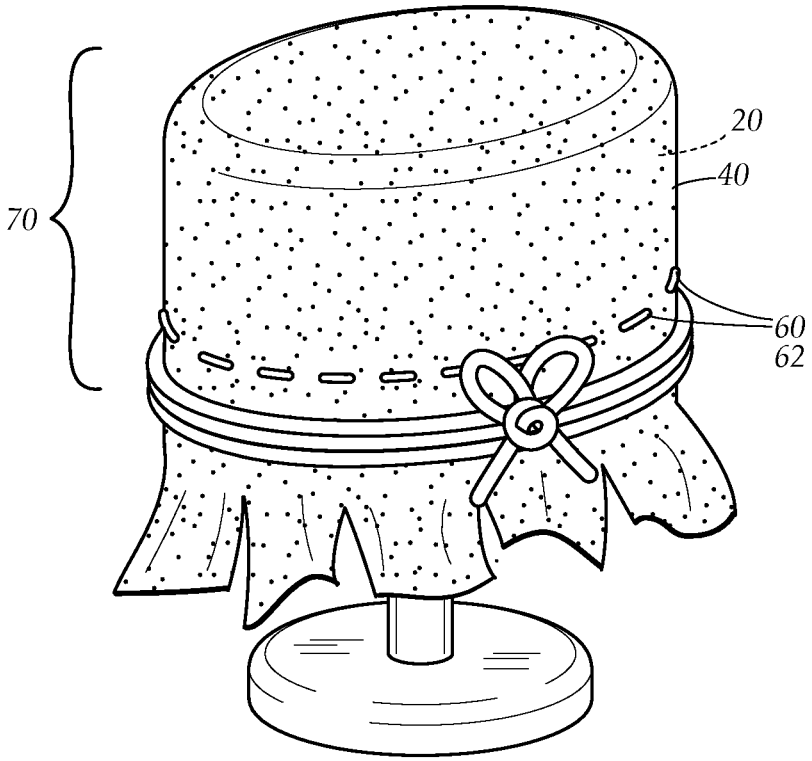
FIG. 8 is a diagrammatic perspective view, illustrating a next step in the process described herein, wherein the covering sheet has been stitched to the upper form along a main stitch line with a fine stitch that has been exaggerated in the drawings for illustration clarity.

FIG. 8 illustrates a next step in the process described herein, wherein a hat upper 70 has been created, wherein the new wrinkle-free position of the covering sheet 40 has been secured in position by stitching the covering sheet 40 to the upper form 20 along a main stitch line 60. The main stitch line is comprised of stitches 62 that are preferably at a repeating period (linear distance across one complete stitch cycle) of substantially one sixteenth of an inch fabric, and extends fully around the hat upper 70 in a circle or closed loop. This fine stitching is done to maintain the tension of the covering sheet 40 upon the upper form 20 in the new position and prevent the covering sheet 40 from drifting upwardly between stitches and creating new wrinkles and creases. Note that in the drawing figures, for the sake of illustration clarity the stitches 62 appear much larger than described above. FIG. 9 illustrates the hat upper 70, defined as the upper form 20 and covering sheet 40 that extend above the upper edge 30U of the ring insert 30, held in place by the stitches 62 of the main stitch line 60. Note that the main stitch line 60 extends just a short distance above upper edge 30U of the ring insert 30. The fine stitching allows this short distance to be minimal and only requires enough space to allow attachment of the hat upper 70 to additional hat components that will be described in further detail hereinbelow. The hat upper 70 is now ready to be separated from a remnant portion 72, which comprises the covering sheet 40 and upper form 20 that extends downwardly from the upper edge 30L of the ring insert 30.

Figure 10:
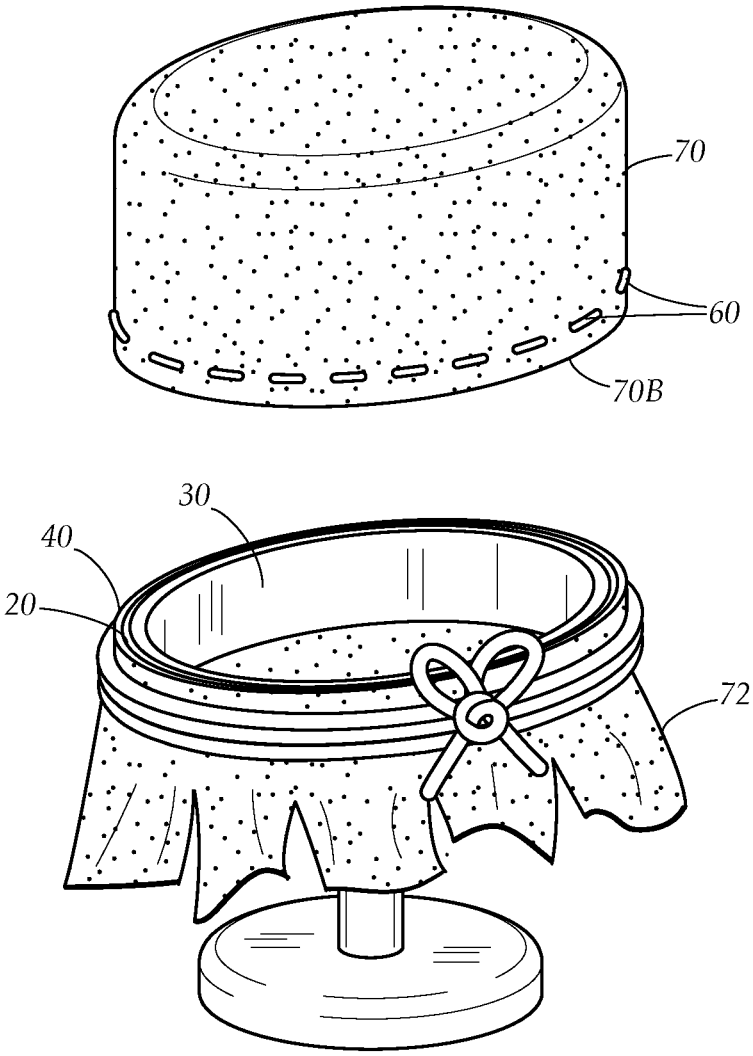
FIG. 10 is a diagrammatic perspective view, wherein the hat upper has been cut by slicing through the fabric sheet and upper form, below the main stitch line and just above and parallel to the ring.

Now in FIG. 10, the hat upper 70 has been severed and separated from the remnant portion 72 at a newly created bottom edge 70B by cutting through the covering sheet 40 and upper form 20 just above the ring insert 30 at a consistent distance therefrom, fully around the hat upper 70 and substantially parallel to the main stitch line 60.

Figure 11A:
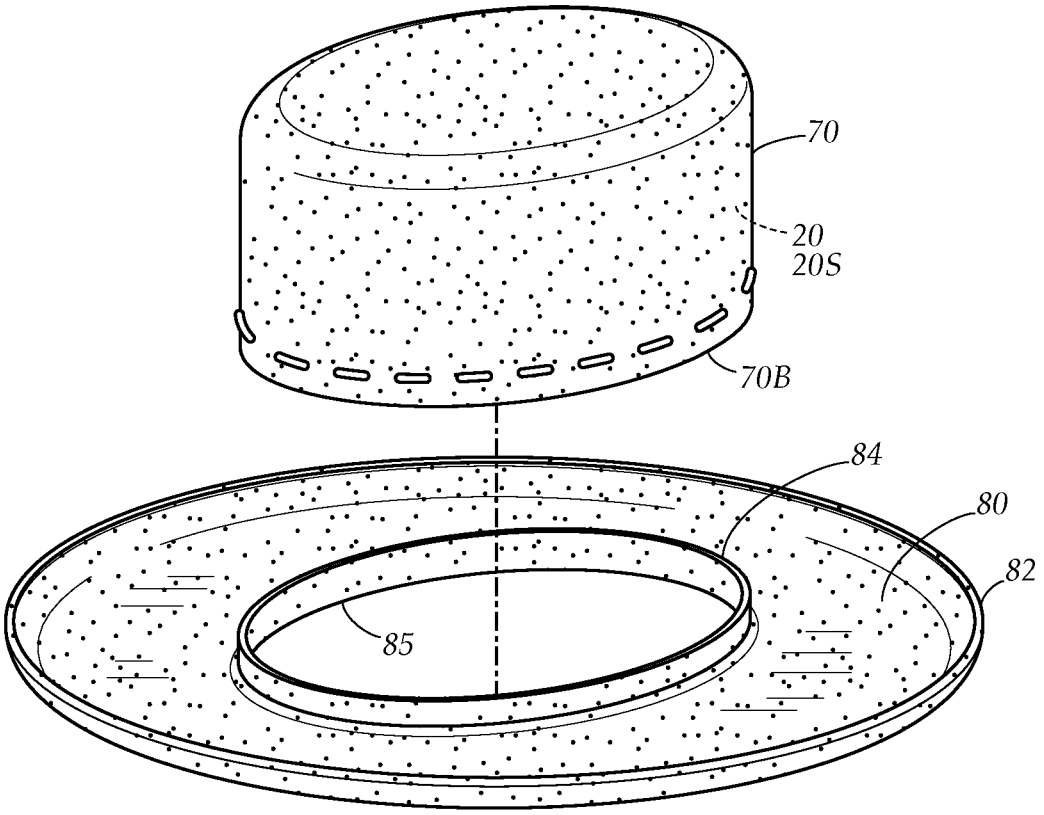
FIG. 11A is a diagrammatic perspective view, illustrating the hat upper along with a hat lower part, the hat upper and hat lower part are about to be attached together.
Figure 11B:
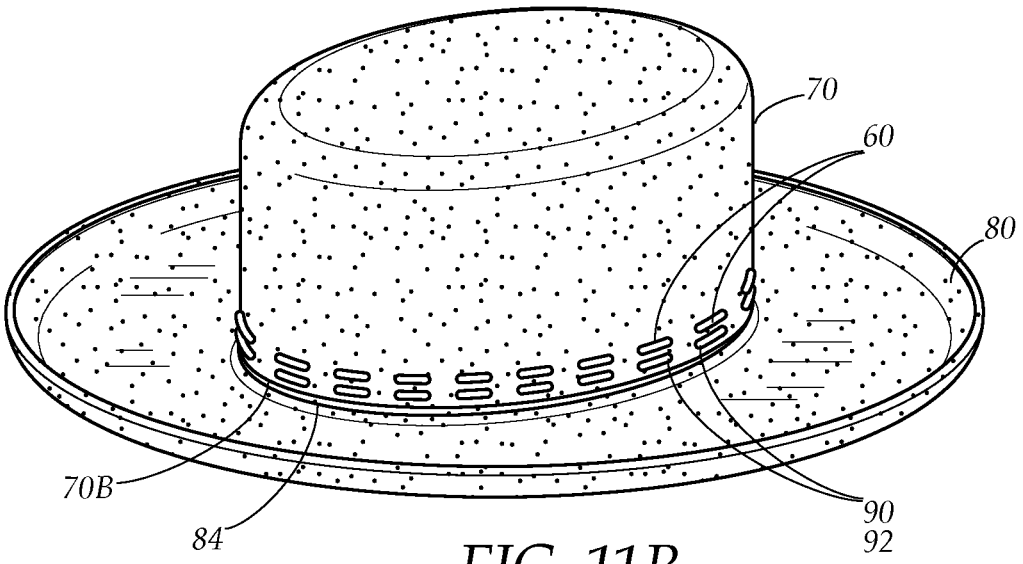
FIG. 11B is a diagrammatic perspective view, wherein the hat upper and hat lower part have been attached together by stitching along an attachment stitch line.
Figure 12A:
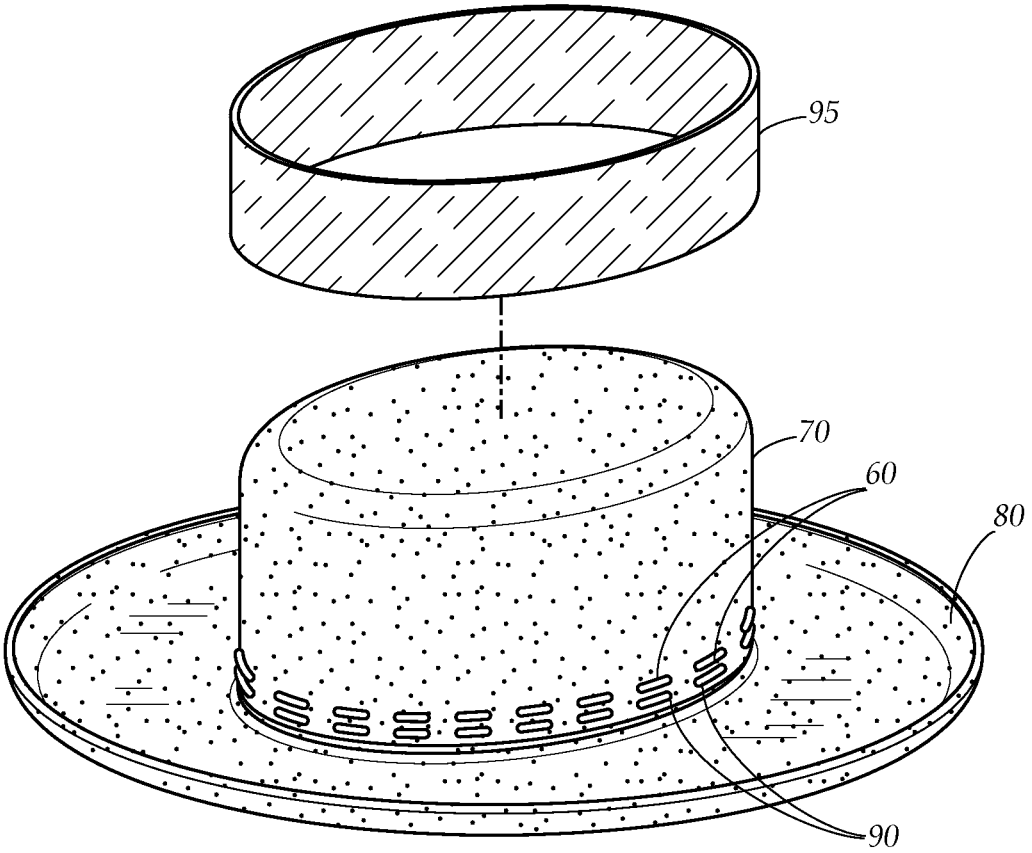
FIG. 12A is a diagrammatic perspective view, illustrating a band cover positioned just above the previously joined hat upper and hat lower part.
Figure 12B:
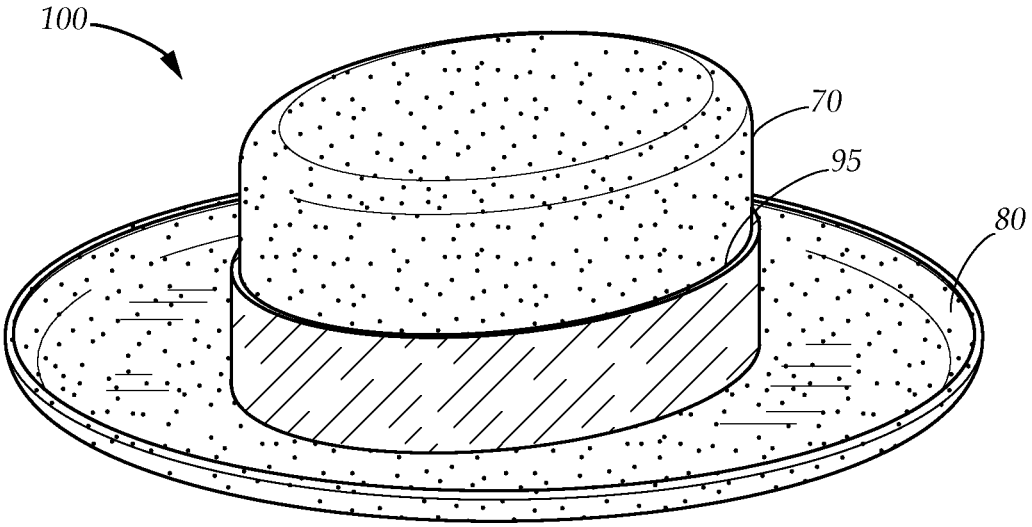
FIG. 12B is a diagrammatic perspective view, wherein the band cover has been inserted downwardly over the hat upper until it is positioned in place, covering the main stitch line and the attachment stitch line.

FIG. 11A illustrates the hat upper 70 along with a hat lower part 80. The hat lower part 80 includes a brim 82 and an inner flange 84 that includes a head opening 85 and protrudes upwardly from the brim in an elongated circular configuration that matches the shape of the side walls 20S of the upper form 20 and is substantially the same size thereof—that is, substantially the same but actually slightly smaller or larger so that the hat upper 70 and hat lower part 80 can nest at the bottom edge 70B and inner flange 84, respectively. Now in FIG. 11B, the hat upper 70 and hat lower part 80 have been attached together by connecting the hat upper 70 at the bottom edge 70B with the inner flange 84 by stitching along an attachment stitch line 90, just below and parallel to the main stitch line 60, that includes attachment stitches 92 that extend through the hat upper 70 just above the bottom edge 70B and through the inner flange 84 of the hat lower part 80. Next, in FIG. 12A, a decorative band 95 is a broad, thin, closed loop of decorative material that is used to stylishly cover and conceal a vertical portion of the hat upper 70 where it is joined with the hat lower part 80. In particular, the decorative band 95 is meant to conceal the main stitch line 60 and the attachment stitch line 90. Then in FIG. 12B, a finished covered hat 100 is illustrated wherein the decorative band 95 is positioned in place between the hat upper 70 and hat lower part 80.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a hat covering system for creating a covered hat that is free from wrinkles and creases. The disclosure is illustrated by example in the drawing figures, and throughout the written description. It should be understood that numerous variations are possible, while adhering to the inventive concept. Such variations are contemplated as being a part of the present disclosure.

What is claimed is:

1. A hat making method, comprising the steps of:

providing an upper form having a top surface, a bottom edge, and orthogonal side walls between the top surface and bottom edge that are in an elongated cylindrical configuration, the upper form is open at the bottom edge and closed at the top surface;

providing a stand having an upper block having a top that is substantially the same size as the top surface of the upper block;

providing a ring insert that is rigid and has an upper edge, a lower edge, and an outer wall and inner wall extending between the upper edge and lower edge;

providing a covering sheet made of a textile material having outer edges and a center;

supporting the upper form with the stand by the top of the upper block extending inside and against the top surface of the upper form by inserting the upper block inside the upper form;

inserting the ring upwardly into the upper form with the lower edge of the ring substantially aligned with the bottom edge of the form;

draping the covering sheet over the upper form with the outer edges of the fabric extending below the bottom edge of the upper form and the center of the covering sheet substantially centered over the top surface of the upper form;

securing the covering sheet against the form by extending and tensioning a rope band around the form between the upper and lower edges of the ring;

removing wrinkles in the fabric by pulling the covering sheet into a new position by pulling the covering sheet near the outer edges downwardly;

creating a hat upper by fixing the fabric to the form in the new position by creating a main stitch line around the upper form by stitching the covering sheet to the upper form above and parallel to the upper edge of the ring; and removing the hat upper by cutting the form between and parallel to the main stitch line and the upper edge of the ring.

2. The hat making process as recited in claim 1, wherein the steps as recited are followed by the steps of:

providing a hat lower part having a brim and an inner flange that protrudes upwardly and has a head opening; and joining the hat upper to a hat lower part by stitching the hat upper to the inner flange of the hat lower part along an attachment stitch line near and parallel to the main stitch line.

3. The hat making process as recited in claim 2, wherein the step of removing wrinkles is preceded by the step of creating strips by cutting the covering sheet radially from the outer edges toward the center; and wherein the step of pulling the covering sheet near the outer edges downwardly further comprises grasping one of the strips.

4. The hat making process as recited in claim 3, wherein stitching the covering sheet to the upper form further comprises creating fine stitches that have a repeating period of substantially one sixteenth of an inch.

5. A hat making method, using an upper form having a top surface, a bottom edge, and orthogonal side walls between the top surface and bottom edge that are in an elongated cylindrical configuration, the form is closed at the top surface and open at the bottom edge, further using a stand having an upper block having a top that is substantially the same size as the top surface of the upper block, a ring insert that is rigid and has an upper edge, a lower edge, and an outer wall and inner wall extending between the upper edge and lower edge, and a covering sheet made of a textile material having outer edges and a center, comprising the steps of:

supporting the upper form with the stand by the top of the upper block extending inside and against the top surface of the upper form by inserting the upper block inside the upper form;

inserting the ring upwardly into the upper form with the lower edge of the ring substantially aligned with the bottom edge of the form;

draping the covering sheet over the upper form with the outer edges of the fabric extending below the bottom edge of the upper form and the center of the covering sheet substantially centered over the top surface of the upper form;

securing the covering sheet against the form by extending and tensioning a rope band around the form between the upper and lower edges of the ring;

removing wrinkles in the fabric by pulling the covering sheet into a new position by pulling the covering sheet near the outer edges downwardly;

creating a hat upper by fixing the fabric to the form in the new position by creating a main stitch line around the upper form by stitching the covering sheet to the upper form above and parallel to the upper edge of the ring; and removing the hat upper by cutting the form between and parallel to the main stitch line and the upper edge of the ring.

6. The hat making process as recited in claim 5, further using a hat lower part having a brim and an inner flange that protrudes upwardly and has a head opening, wherein the steps as recited are followed by the step of joining the hat upper to a hat lower part by stitching the hat upper to the inner flange of the hat lower part along an attachment stitch line near and parallel to the main stitch line.

7. The hat making process as recited in claim 6, wherein the step of removing wrinkles is preceded by the step of creating strips by cutting the covering sheet radially from the outer edges toward the center; and wherein the step of pulling the covering sheet near the outer edges downwardly further comprises grasping one of the strips.

8. The hat making process as recited in claim 7, wherein stitching the covering sheet to the upper form further comprises creating fine stitches that have a repeating period of substantially one sixteenth of an inch.

* * * * *